US006097136A

United States Patent [19]

Oh

[11] Patent Number: 6,097,136

[45] Date of Patent: Aug. 1, 2000

[54] SPARK PLUG FOR HAVING SLIDABLY WIPING DEVICE FOR CLEANING CARBON DEPOSITS

[75] Inventor: Bu-Suk Oh, Ulsan Kyungsangnam-do, Rep. of Korea

[73] Assignee: Hyundai Motor Co., Seoul, Rep. of Korea

[21] Appl. No.: 08/959,924

[22] Filed: Oct. 29, 1997

[30] Foreign Application Priority Data

Nov. 5, 1996 [KR] Rep. of Korea ..... 96-52944

[51] Int. Cl.[7] ..... H01T 13/20; H01T 13/22; H01T 13/34; H01T 13/36

[52] U.S. Cl. ..... 313/141 X; 313/118; 313/127; 313/143; 313/145; 123/169 CL

[58] Field of Search ..... 313/118, 125, 313/127, 135, 141, 145, 146, 148; 123/169 R, 169 CL, 169 CM, 169 EL

[56] References Cited

U.S. PATENT DOCUMENTS

| | | | |
|---|---|---|---|
| 1,332,704 | 3/1920 | Aschinger | 313/127 |
| 1,369,311 | 2/1921 | Westcott | 313/127 |
| 1,388,766 | 8/1921 | Scherer | 313/127 |
| 1,398,797 | 11/1921 | Rapson | 313/127 |
| 1,525,415 | 2/1925 | Seibert, Jr. | 313/127 |

*Primary Examiner*—Nimeshkumar D. Patel
*Assistant Examiner*—Mack Haynes

[57] ABSTRACT

A spark plug for use in a combustion engine, which includes a spark plug body defining a central cavity; a electrode disposed within the cavity; a spring means disposed in one end portion of the central cavity; and a plate means operatively associated at one end with the spring means and adapted to communicate at its other end with the electrode whereby when the engine starts, the respective compression and explosion strokes move the plate means in one direction against the bias of the spring and in the opposite direction by the force of the spring, which in turn moves the other end of the plate in communication with the electrode in the same manner whereby combustion carbon collected on the electrode can be effectively removed.

4 Claims, 3 Drawing Sheets

SPARK PLUG FOR HAVING SLIDABLY WIPING DEVICE FOR CLEANING CARBON DEPOSITS

BACKGROUND OF THE INVENTION

1. Field of the Invention

The present invention relates to a spark plug for use in a combustion engine and more particularly, to an improved spark plug containing a U-shaped plate which moves in the up and down direction, caused by a compression stroke and an explosion stroke for cleaning up carbon deposited on a central electrode.

2. Description of Related Art

Various types of spark plugs for use in a combustion engine are known in the art. Generally speaking, as combustion is proceeding in a combustion engine, carbon generated therefrom is deposited on the grounding electrode.

As shown in FIG. 1, a conventional spark plug for use in a combustion engine includes a central electrode 3' and a ground electrode 8' for sparking a flame with a high voltage electric current from an ignition coil through the central electrode 3' to a compressed gas mixture in the combustion chamber. At this time, combusted gas generates carbon 10' which is deposited on the central electrode 3'. In such a conventional spark plug, the deposited carbon is removed by heating and maintaining the central electrode 3' at a high temperature of 450–950° C.

However, in such a conventional spark plug the temperature of the central electrode 3' changes and cannot maintain the original temperature because of the driving situation of the combustion engine. Therefore, over time carbon 10 is deposited around the central electrode 3'. Accordingly, such a conventional spark plug cannot avoid the deposition of carbon on its surface.

SUMMARY OF THE INVENTION

Accordingly, it is an object of the present invention to provide a spark plug for use in a combustion engine, which eliminates the above problems encountered with conventional spark plugs.

Another object of the present invention is to provide an improved spark plug for use in a combustion engine, which includes a U-shaped plate which moves up and down corresponding to a compression stroke and an explosion stroke, for removing carbon deposited on the central electrode when the combustion in a combustion chamber is proceeding.

A further object of the present invention is to provide a spark plug for use in a combustion engine which is simple in structure, inexpensive to manufacture, and durable in use.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a spark plug for use in a combustion engine, which includes a U-shaped plate disposed around the end of a centrally disposed electrode for movement in the upward and downward direction to remove carbon deposited on the central electrode.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
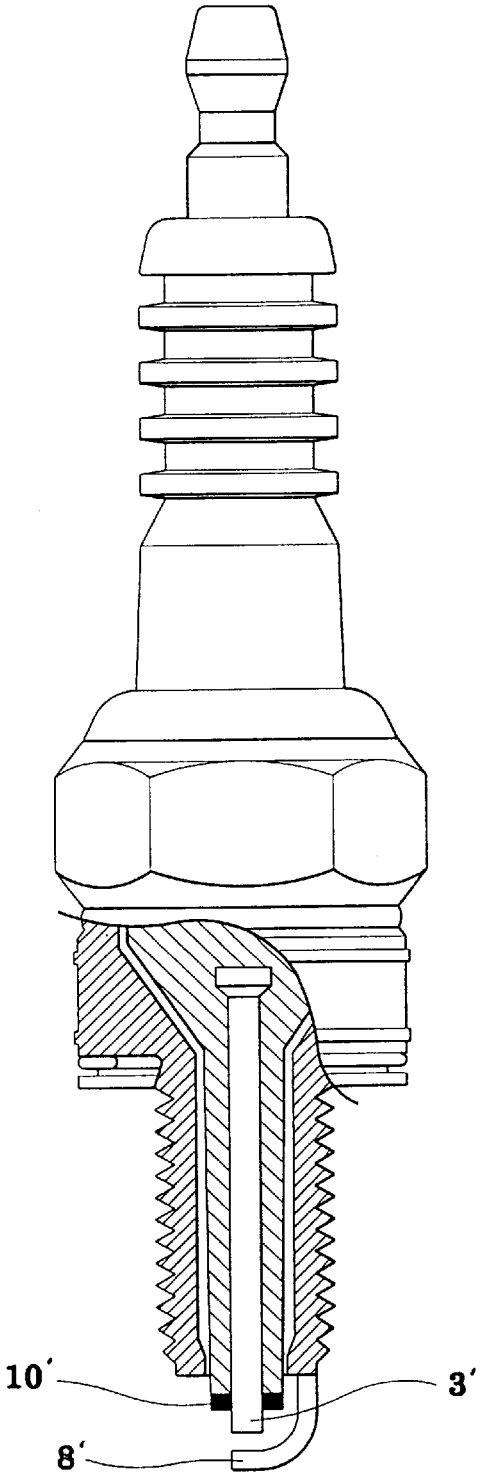
FIG. 1 CONVENTIONAL ART
FIG. 1 is a front elevational view of a conventional spark plug for use in a combustion engine containing cut-away portions for illustrating the construction of conventional spark plugs.
Figure 2:
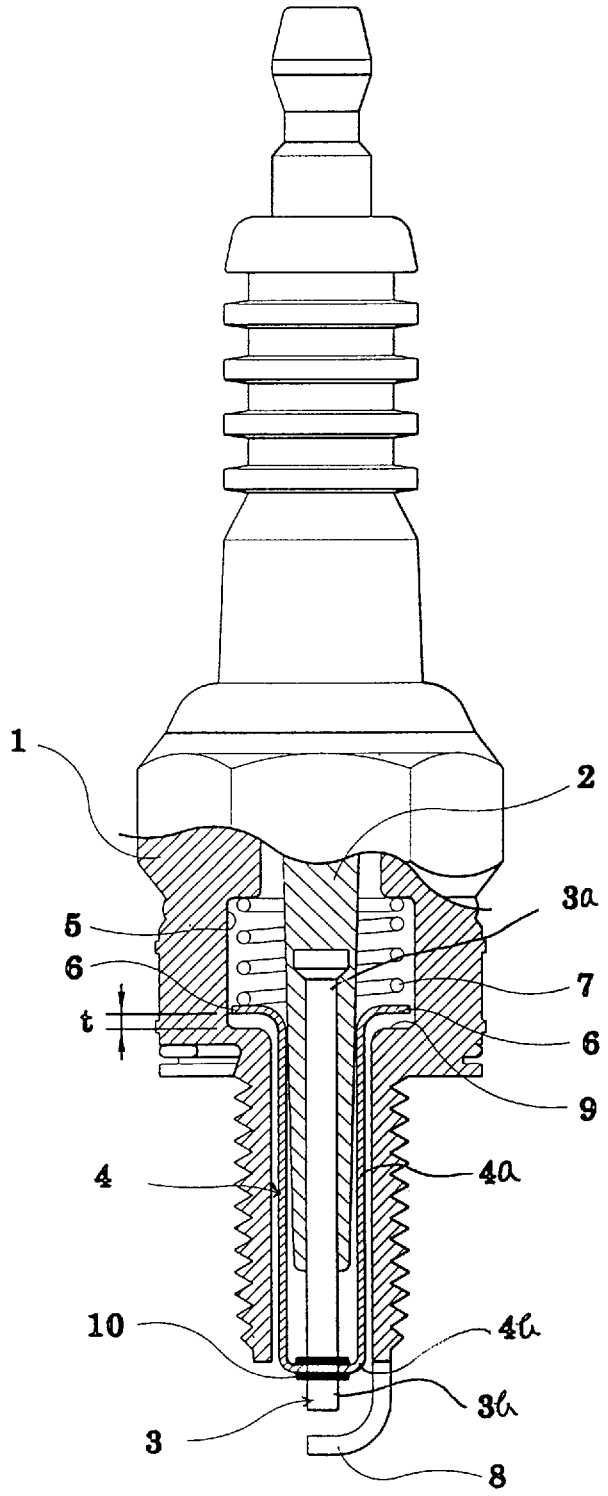
FIG. 2 is a front elevational view of a spark plug for use in a combustion engine according to the present invention containing cut-away portions for illustrating the construction of the spark plug of the present invention, in the compression stroke position.
Figure 3:
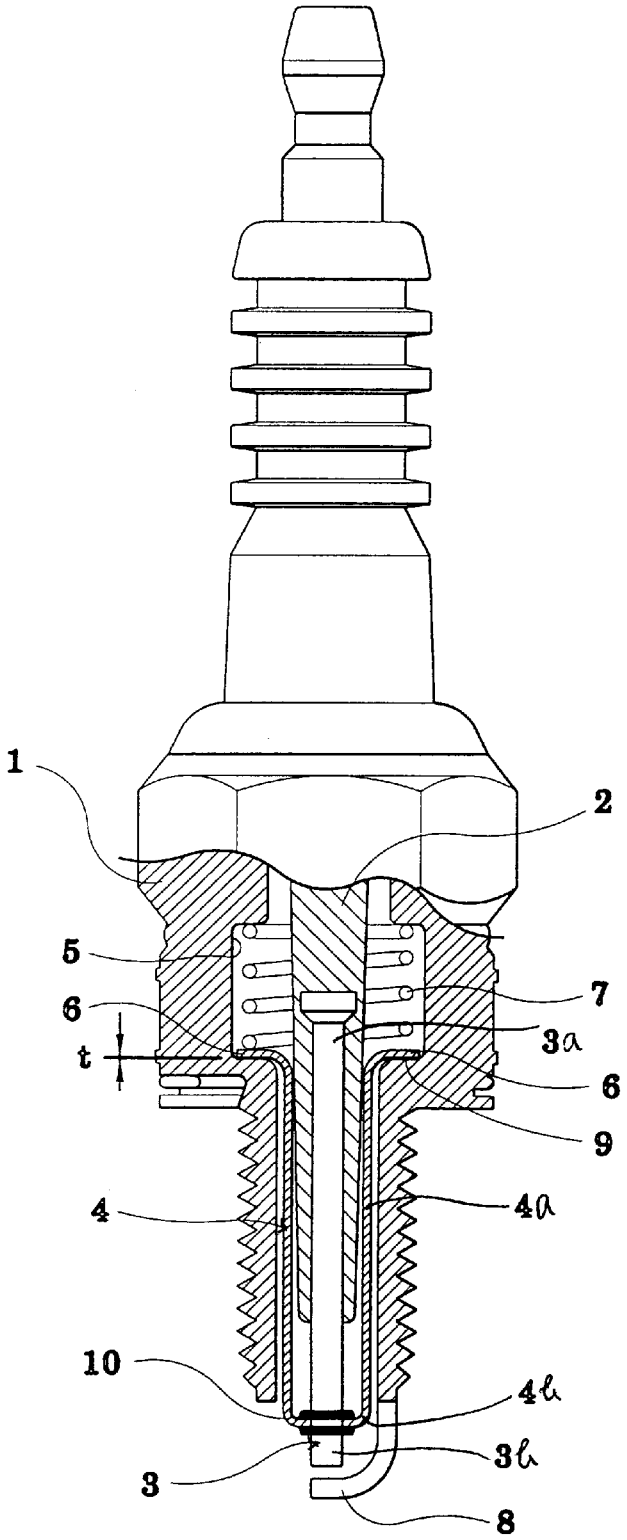
FIG. 3 is a front elevational view of a spark plug for use in a combustion engine according to the present invention containing cut-away portions for illustrating the construction of the spark plug of the present invention, in the explosion stroke position.

Referring now in detail to the drawings for the purpose of illustrating preferred embodiments of the present invention, the spark plug for use in a combustion engine, as shown in FIGS. 2 and 3, comprises a central electrode 3 protected with an insulator 2 disposed within the center of a plug body 1, a support spring 7 surrounding the insulator and the upper portion 3*a* of the central electrode 3, a U-shaped plate 4 having a pair of outward bending ends 6 thereof disposed between the support spring 7 and a support raised portion (shoulder) 9 of the central cavity 5 supported by the support spring 7 and a bottom portion 4*b* thereof disposed around the lower portion 3*b* of the central explode 3, and a ground electrode 8 facing the central electrode 3.

The U-shaped plate 4 has a plate body disposed within the central cove of the plug body 1 for movement in the up and down direction by a pushing force from the compressed stroke of a combustion engine (FIG. 2) and the biasing force of the support spring 7 (FIG. 3). This action cleans up carbon 10 deposited on the surface portion of the central electrode 3 when the spark plug sparks. During this time, the U-shaped plate 4 moves up a distance "t" from the raised portion 9 of the central cavity 5 as shown in FIG. 2 and moves down a distance "t" in the vicinity of the raised portion 9 as shown in FIG. 3 for cleaning up the carbon 10. The U-shaped plate 4 is made of steel, ceramic, aluminum, and the like.

Referring to FIGS. 2 and 3, the spark plug for use in a combustion engine according to the present invention operates as follows. When the combustion engine starts with the compressed stroke of a piston (not shown), the U-shaped plate 4 moves up a distance "t" due to an increase in the pressure in the combustion chamber (not shown). At this time, since the force of the pressure in the combustion chamber is greater than the biasing force of the support spring 7, the U-shaped plate 4 compresses the support spring 7 a distance "t". Therefore, the pair of outwardly bending ends 6 of the U-shaped plate is separated from the support raised portion 9 a distance "t" as shown in FIG. 2. Of course, at this time, the carbon 10 deposited on the low portion 3*b* of the central electrode 3 is effectively cleaned due to the upward movement of the bottom portion 4*b* of the U-shaped plate 4.

As shown in FIG. 3, when the combustion engine proceeds to an explosion stroke of the piston, the U-shaped plate 4 moves down a distance "t" from the position of the U-shaped plate 4 in FIG. 2 by the biasing force of the support spring 7, due to the downward movement of the piston. At this time, the U-shaped plate 4 moves down a distance "t", so that the pair of outward bending ends 6 move to the vicinity of the support raised portion 9. Therefore, the carbon 10 deposited on the central electrode 3 is effectively cleaned up due to the downward movement of the bottom 4*b* of the U-shaped plate 4.

Accordingly, a spark plug used in a combustion engine according to the present invention can effectively remove the carbon deposited on the lower portion of the central electrode by the up and down movement of the U-shaped plate 4 due to the compressed and explosion strokes of the piston. Thus, the spark is improved which decreases the quantity of exhaust gas and improves engine power.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A spark plug for use in a combustion engine, which comprises:

a spark plug body defining a centrally disposed cavity which extends through said body and defines an upper chamber and a lower chamber, said upper chamber being identified from said lower chamber by opposing shoulders;

an insulator shaft disposed on the longitudinal axis of said body, and extending between the upper chamber and lower chamber;

an electrode disposed within said insulator shaft and extending from the upper chamber into the lower chamber, said electrode having an exposed portion extending beyond the insulator shaft;

spring means disposed within the upper chamber of said cavity; and a wiping device slidably disposed about said insulator shaft containing at one end thereof outwardly extending arms which are operative to move between said spring means and said shoulders, the other end of said wiping device extending into said lower chamber for operative engagement with said exposed portion of the electrode, whereby when the engine starts, the respective compression and explosion strokes move the wiping device in one direction against the bias of the spring and in the opposite direction by the force of the spring, which in turn moves said other end of said wiping device in communication with said exposed portion of the electrode in the same manner whereby combustion carbon collected on said electrode can be effectively removed.

2. The spark plug of claim 1, wherein said wiper device is made of steel.

3. The spark plug of claim 1, wherein said wiper device is made of ceramic.

4. The spark plug of claim 1, wherein said wiper device is made of aluminum.

* * * * *